US006670743B2

(12) United States Patent
Ito et al.

(10) Patent No.: US 6,670,743 B2
(45) **Date of Patent: *Dec. 30, 2003**

(54) COLOR CATHODE RAY TUBE HAVING A SHADOW MASK STRUCTURE

(75) Inventors: Hiroshi Ito, Mobara (JP); Nobuhiko Hosotani, Mobara (JP); Mitsuru Watanabe, Mutsuzawa-machi (JP); Haruhiko Yoshida, Sakura (JP)

(73) Assignee: Hitachi, Ltd., Tokyo (JP)

( * ) Notice: Subject to any disclaimer, the term of this patent is extended or adjusted under 35 U.S.C. 154(b) by 11 days.

This patent is subject to a terminal disclaimer.

(21) Appl. No.: 09/978,575

(22) Filed: Oct. 18, 2001

(65) Prior Publication Data

US 2002/0017850 A1 Feb. 14, 2002

Related U.S. Application Data

(63) Continuation of application No. 09/344,540, filed on Jun. 25, 1999, now Pat. No. 6,307,311.

(30) Foreign Application Priority Data

Jun. 26, 1998 (JP) ..... 10-180949

(51) Int. Cl.[7] ..... H01J 29/80; H01J 29/07
(52) U.S. Cl. ..... 313/407; 313/402
(58) Field of Search ..... 313/402, 404, 313/407

(56) References Cited

U.S. PATENT DOCUMENTS

| | | | |
|---|---|---|---|
| 4,286,189 A | 8/1981 | Koizumi et al. | |
| 4,437,036 A | 3/1984 | Ragland, Jr. | |
| 4,748,371 A | 5/1988 | Bauder | |
| 5,315,208 A | 5/1994 | van der Bolt et al. | |
| 5,686,784 A | 11/1997 | Thoms et al. | |

FOREIGN PATENT DOCUMENTS

| | | | |
|---|---|---|---|
| EP | 0 795 886 | | 9/1997 |
| JP | 60-40942 | | 3/1985 |
| JP | 8-64146 | | 3/1996 |
| WO | 98/12729 | * | 3/1998 |

* cited by examiner

*Primary Examiner*—Ashok Patel
(74) *Attorney, Agent, or Firm*—Antonelli, Terry, Stout & Kraus, LLP

(57) ABSTRACT

A color cathode ray tube includes a generally rectangular shadow mask structure in which a skirt portion of a shadow mask is secured to a support frame. The shadow mask is formed by an apertured portion having a large number of electron beam transmission apertures, an imperforate portion disposed around the entire periphery of the apertured portion, a skirt portion being bent back and drooping from the entire periphery of the imperforate portion, and a support frame including a rectangular frame portion. The skirt portion of the shadow mask is secured to the inside of the rectangular frame portion, and a bent portion of the shadow mask, which defines a transitional region between the imperforate portion, and the skirt portion is formed in a shape where long sides are recessed inwardly and ends of the long sides of the skirt portion come into contact with the frame portion.

5 Claims, 5 Drawing Sheets

COLOR CATHODE RAY TUBE HAVING A SHADOW MASK STRUCTURE

CROSS REFERENCE TO RELATED APPLICATION

This is a continuation of U.S. application Ser. No. 09/344,540, filed Jun. 25, 1999, now U.S. Pat. No. 6,307,311.

BACKGROUND OF THE INVENTION

The present invention relates to a color cathode ray tube having a shadow mask structure; and, more particularly, the invention relates to a color cathode ray tube having a shadow mask structure in which close contact is provided between a skirt portion of the shadow mask and the inside of a frame portion of a supporting frame during its assembling operation, the magnetic resistance between the shadow mask and the frame portion is reduced, and a change in the curved surface of the shadow mask after such an assembling is avoided.

Generally, a shadow mask structure as used in a color cathode ray tube, comprises a shadow mask, which is produced by integrally press-forming a metal sheet to form an apertured portion having an approximately rectangular shape and having a large number of electron transmission apertures, an imperforate portion formed in an approximately rectangular frame shape and disposed around and contingously connected with the entire periphery of the apertured portion and a skirt portion which is bent back and drooping from the entire periphery of the imperforate portion, and a support frame, which holds the shadow mask after fitting the skirt portion of the shadow mask into the inside of the approximately rectangular frame portion. Thereafter, the shadow mask and the support frame are secured to each other by spot-welding parts of the fitted portion.

FIG. 4A and FIG. 4B are structural views showing one example of the construction of a known shadow mask structure, wherein FIG. 4A is a plan view, and FIG. 4B is a cross-sectional view of FIG. 4A taken along a line A—A.

In. FIG. 4A and FIG. 4B, numeral 40 generally indicates a shadow mask structure, numeral 41 indicates a shadow mask, numeral 42 indicates a support frame, numeral 43 indicates an apertured portion of the shadow mask, numeral 44 indicates an imperforate portion of the shadow mask, numeral 45 indicates a skirt portion of the shadow mask, numeral 46 indicates welding bosses of the support frame and numeral 47 indicates frame reinforcing bosses of the support frame.

The shadow mask 41 has a given curvature and comprises the apertured portion 43 having a large number of electron beam transmission apertures (not all shown in drawings), an imperforate portion 44 disposed around the entire periphery of the apertured portion 43 and having a curvature which is contiguous with the apertured portion 43, and a skirt portion 45 being bent back and drooping from the entire periphery of the imperforate portion 44 to have a given height. The shadow mask 41 is integrally formed by press-forming a metal material. The support frame 42 includes a frame portion having an approximately rectangular outer shape and a flange portion which extends approximately perpendicularly from the frame portion. Welding bosses 46 are formed in approximately central portions of the two long sides and the two short sides, as well as the four corners of the support frame 42, in the form of slightly bulging portions extending in a direction of the height (frame width) of the frame portion inwardly. Contiguous with these welding bosses 46, frame reinforcing bosses 47 are formed by slightly bulging portions extending in a direction of the height (frame width) further inwardly.

With such a construction, in forming the shadow mask structure 40, the skirt portion 45 of the shadow mask 41 is fitted into the inside of the frame portion of the support frame 42 against a curl of the skirt portion 45, which is produced at the time of the press-forming, and the end of the skirt portion 45 is brought into contact with the upper side of the frame reinforcing bosses 47. While holding this condition, the given locations between the skirt portion 45 and the welding bosses 46 are spot welded, whereby the shadow mask 41 is mounted on the support frame 42.

Thereafter, in a well known manner, the constructed shadow mask structure 40 is mounted inside of the panel portion (not shown in drawings) of the color cathode ray tube, such that the shadow mask 41 faces a phosphor film formed on the inner surface of a face plate of the panel portion, and then various constitutional components are mounted on respective portions of the color cathode ray tube, and subsequently, sealing, exhausting and heating treatment are carried out to complete the color cathode ray tube equipped with the shadow mask structure.

In the color cathode ray tube equipped with the above-mentioned known shadow mask structure, the skirt portion 45 of the shadow mask 41 is fitted into the inside of the frame portion of the support frame 42 and the parts of the fitted portion of the skirt portion 45 and the parts of the welding bosses 46 formed in respective parts of the frame portions are spot welded. At regions formed on approximately central portions of the respective long sides and the respective short sides and at the respective corners of the frame portion to which the welding bosses 46 are provided, the fitted portion of the skirt portion 45 and the welding bosses 46 of the frame portion are held in a closely contacted condition. At remaining regions, however, the fitting portions of the skirt portion 45 and the frame portion are slightly spaced apart from each other so that there exist regions of less or no contact between the skirt portion 45 and the frame portion; and hence, the magnetic resistance between the skirt portion 45 and the frame portion is large.

Accordingly, in the color cathode ray tube equipped with the know shadow mask structure, at the time of displaying an image, a large magnetic resistance is generated between the skirt portion 45 and the frame portion, so that the amount of migration of the electron beam corresponding to a fluctuation of the terrestrial magnetism becomes large. Accordingly, this gives rise to problems in that an adverse effect is given to the purity characteristics or a white halo is generated.

Furthermore, in the color cathode ray tube equipped with a known shadow mask structure, when any vibration is applied to the color cathode ray tube, because of the regions where there is little contact between the skirt portion 45 and the frame portion, the shadow mask per se is vibrated by such a vibration, so that there arises a problem in that beam landing errors occur.

A method of solving such problems is disclosed in JP-A10-149728. Namely, JP-A-10-149728 discloses a shadow mask structure for a color cathode ray tube which is characterized in that the frame portion of the support frame is formed such that respective long sides and the respective short sides thereof have sufficiently large radii of curvature, similar to those of planes having no welding bosses, and respective corners thereof are formed in a curved surface shape having a small radius of curvature, while a skirt portion of a shadow mask has the respective long sides and the respective short sides thereof formed in a shape close to the shape of the respective long sides and the respective short sides of the frame portion having the sufficiently large radii of curvature, and respective corners thereof are formed in a shape close to a curved surface shape having the small radius of curvature of respective corners of the frame portion of the support frame.

The shadow mask structure according to JP-A-10-149728 can increase the area of contact between the frame portion of the support frame and the fitting portion of the skirt portion of the shadow mask so that the magnetic resistance between the skirt portion and in the frame portion is small; and, furthermore, even when an external vibration is applied, the shadow mask per se is prevented from being vibrated. However, the formed shape of the skirt portion of the shadow mask and the shape of the frame portion of the support frame are similar as a whole. Accordingly, in case the amount of curl is large at the time of forming the skirt portion, the assembly operation in which the skirt portion is fitted into the frame portion becomes difficult. Furthermore, because of this difficultly in fitting there arises a problem in that the apertured portion of the shadow mask suffers from a slight deformation at the time of fitting the skirt portion into the frame portion.

SUMMARY OF THE INVENTION

The present invention has been based on the above-described technical background, and it is an object of the present invention to provide a color cathode ray tube which is equipped with a shadow mask structure which exhibits little magnetic resistance between the shadow mask and the support frame, which prevents the shadow mask from being vibrated in response to an external vibration, which has a favorable operability during assembling, and which exhibits no deformation of the apertured portion of the shadow mask.

To achieve the above-mentioned object, according to the present invention, the skirt portion of the shadow mask is formed such that the respective long sides and the respective short sides thereof are recessed inwardly with sufficiently large radii of curvature and respective corners have a curved surface having a small radius of curvature, and the frame portion of the support frame is formed such that the respective long sides and the respective short sides thereof are formed in a shape close to a plane which has no welding bosses and respective corners are formed in the shape of a curved surface having a radius of curvature sufficiently close to the radius of curvature of the respective corners of the shadow mask. The shadow mask structure is such that the vicinity of the outside end portion of the skirt portion is brought into close contact with the inside of the frame portion of the support frame. Furthermore, the shadow mask structure is such that the shadow mask and the support frame are welded at the central portions of the sides and the corner portions thereof.

DETAILED DESCRIPTION OF THE INVENTION

Figure 1:
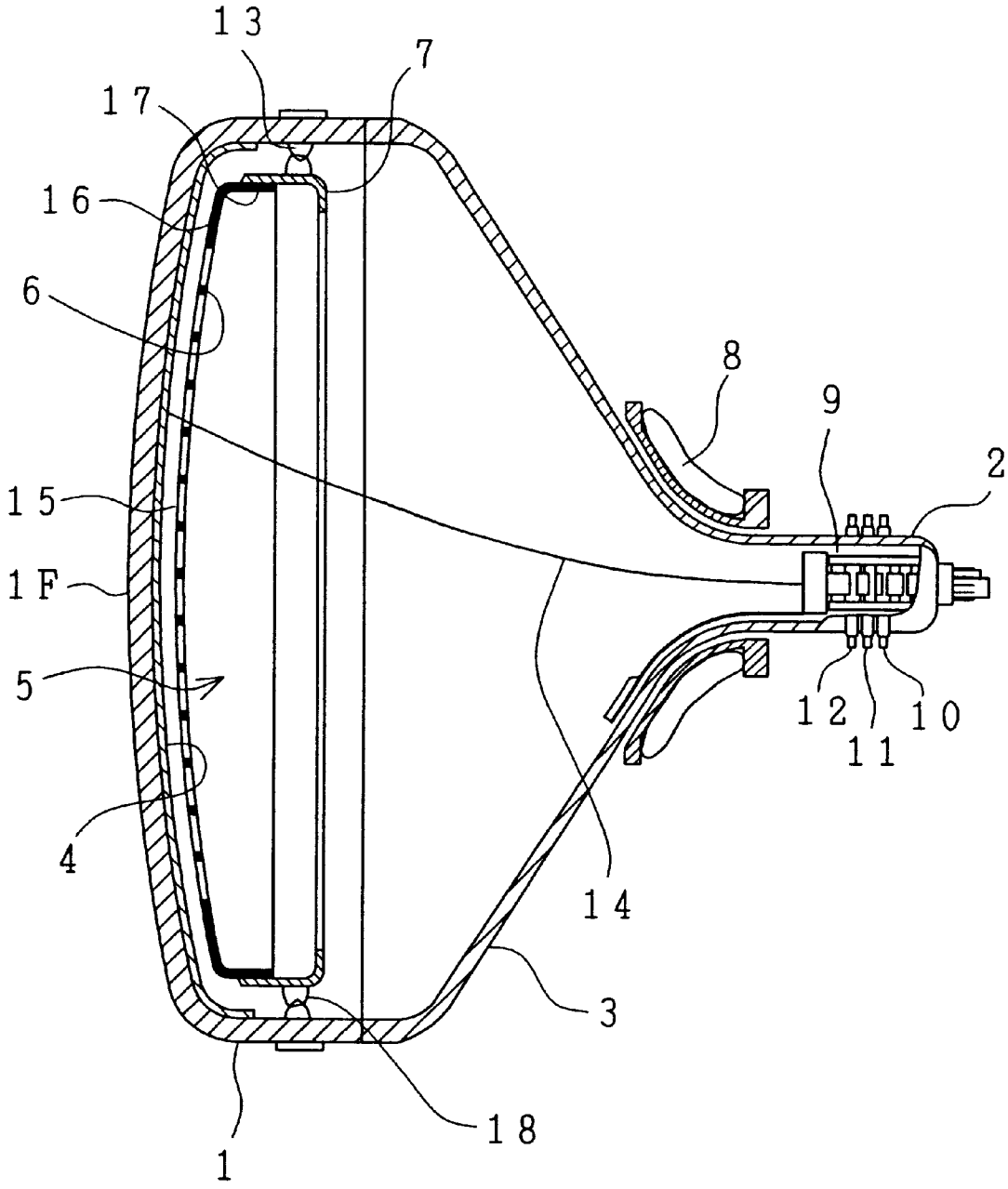
FIG. 1 is a schematic cross-sectional view of an embodiment of a color cathode ray tube equipped with a shadow mask according to the present invention.

According to the present invention, the shadow mask structure includes a shadow mask, formed by integrally molding a rectangular apertured portion having a large number of electron beam transmission apertures, a rectangular frame imperforate portion contiguously disposed around the entire periphery of the apertured portion and a skirt portion being bent back and drooping from the entire periphery of the imperforate portion, and a support frame which allows the skirt portion of the shadow mask to fit into and to be spot-welded to the inside of a rectangular frame portion thereof. The skirt portion of the shadow mask is formed in a shape such that the respective long sides and the respective short sides thereof have sufficiently large radii of curvature and are inwardly recessed and respective corners thereof are formed in a shape of a curved surface having a small radius of curvature, and the frame portion of the support frame is formed in a shape such that the respective long sides and the respective short sides thereof have a shape close to planes having no welding bosses, and respective corners of the support frame are formed in a shape of a curved surface having a radius of curvature sufficiently close to the radius of curvature of the respective corners of the shadow mask, whereby when the skirt portion is fitted into the frame portion, the skirt portion and the frame portion are closely brought into contact with and spot-welded to each other, thus providing the shadow mask structure.

In a preferred example of the mode for carrying out the present invention, the color cathode ray tube equipped with such a shadow mask structure is designed such that the respective long sides and the respective short sides of the skirt portion of the shadow mask have a sufficiently large radii of curvature equal to or exceeding 20000 mm.

In a preferred example of the mode for carrying out the present invention, in the shadow mask structure formed by fitting the skirt portion of the shadow mask into the inside of the frame portion of the support frame and spot welding them to each other, $1.0\ \text{mm} \leqq D_H \leqq 1.8\ \text{mm}$, $1.0\ \text{mm} \leqq D_V \leqq 1.8\ \text{mm}$, $0.2\ \text{mm} \leqq D_S \leqq 1.0\ \text{mm}$, where $D_H$, $D_V$ and $D_S$ represent the distance between the inner peripheral surface of the end of the frame portion and the outer peripheral surface of the skirt portion which faces the inner peripheral surface of the end of the frame portion taken along a center line extending vertically at the respective long sides, along a center line extending horizontally at the respective short sides and along diagonal lines at the respective corners, respectively.

According to the mode for carrying out the invention, the frame portion of the support frame in the shadow mask structure is formed such that the respective long sides and the respective short sides thereof are formed in a shape close to planes having no welding bosses, and the skirt portion of the shadow mask is formed in a shape such that the respective long sides and the respective short sides thereof are recessed inwardly with sufficiently large radii of curvature. Therefore, at the time of producing the shadow mask structure, in an assembling operation to fit the skirt portion of the shadow mask into the inside of the frame portion of the support frame, the skirt portion can be fitted into the inside of the frame portion smoothly. Furthermore, the operability at the time of fitting is enhanced, and even after the completion of the fitting operation, no substantial stress is applied to the apertured portion of the shadow mask so that apertured portion of the shadow mask is free from deformation. In a condition where the skirt portion has been fitted into the frame portion, the fitted portion of the skirt portion has its entire periphery in contact with the inside of the frame portion, and, hence, the close contact between the skirt portion and the frame portion is remarkably enhanced, whereby the magnetic resistance between the shadow mask and the frame portion is small; and, even when an external vibration is applied to the cathode ray tube, the shadow mask is prevented from being vibrated.

An embodiment of the present invention will be explained hereinafter with reference to the drawings.

FIG. 1 is a schematic cross sectional view showing an embodiment of a color cathode ray tube equipped with a shadow mask structure according to the present invention.

In FIG. 1, numeral 1 indicates a panel portion, numeral 1F indicates a faceplate, numeral 2 indicates a neck portion, numeral 3 indicates a funnel portion, numeral 4 indicates a phosphor layer, numeral 5 indicates a shadow mask structure, numeral 6 indicates a shadow mask, numeral 7 indicates a support frame, numeral 8 indicates a deflection yoke, numeral 9 indicates an inline type electron gun, numeral 10 indicates a purity adjustment magnet, numerals 11 and 12 indicate static convergence adjustment magnets, numeral 13 indicates connecting pins, numeral 14 indicates electron beams, numeral 15 indicates an apertured portion of the shadow mask 6, numeral 16 indicates an imperforate portion of the shadow mask 6, numeral 17 indicates a skirt portion of the shadow mask 6, and numeral 18 indicates suspending springs mounted on the support frame 7.

A tube body (glass bulb) which constitutes the color cathode ray tube comprises the panel portion 1 which forms the front face side of the tube body, the neck portion 2 having an elongated shape disposed at the rear face side of the tube body and accommodating the electron gun 9, and the funnel portion 3 which connects the panel portion 1 with the neck portion 2. In the panel portion 1, the phosphor film 4 is formed on the inner surface of the faceplate 1F, and the shadow mask structure 5 made up of the shadow mask 6 and the support frame 7 is disposed in the inside of the panel portion 1. The shadow mask 6 is disposed such that it faces the phosphor film 4. The support frame 7 has the suspending springs 18 mounted on the side walls thereof engaged with connecting pins 13 mounted in the inside of the panel portion 1 so that the shadow mask structure 5 is fixedly secured to the inside of the panel portion 1. The shadow mask 6 includes the apertured portion 15 which has a curved surface shape and faces the phosphor film 4, the imperforate portion 16 which is contiguously connected with the entire periphery of the apertured portion 15, and the skirt portion 17 which droops from the entire periphery of the imperforate portion 16, wherein the skirt portion 17 is fitted into and welded to the inside of a frame portion 71 of the support frame 7. A magnetic shield (not shown in drawings) is disposed at the inside of a joining region of the panel portion 1 and the funnel portion 3, while the deflection yoke 8 is mounted at the outside of the joining region of the funnel portion 3 and the neck portion 2. Around the outer periphery of the neck portion 2, the purity adjustment magnet 10 and the static convergence adjustment magnets 11, 12 are disposed in a juxtaposed relationship. Three electron beams 14 (only one beam is shown in FIG. 1) projected from the inline type electron gun 9 are deflected in a desired scanning direction by the deflection yoke 8 and thereafter impinge on corresponding phosphor picture elements of the phosphor layer 4 after passing through the large number of electron beam transmission apertures (not shown in drawings) formed on the apertured portion 15 of the shadow mask 6.

The operation of the color cathode ray tube having the above-mentioned construction, namely, the image display operation, is the same as that of the known color cathode ray tube, and such image display operation is well known. Therefore, a description of the image display operation in the color cathode ray tube according to the present embodiment will be omitted.

Figure 2A:
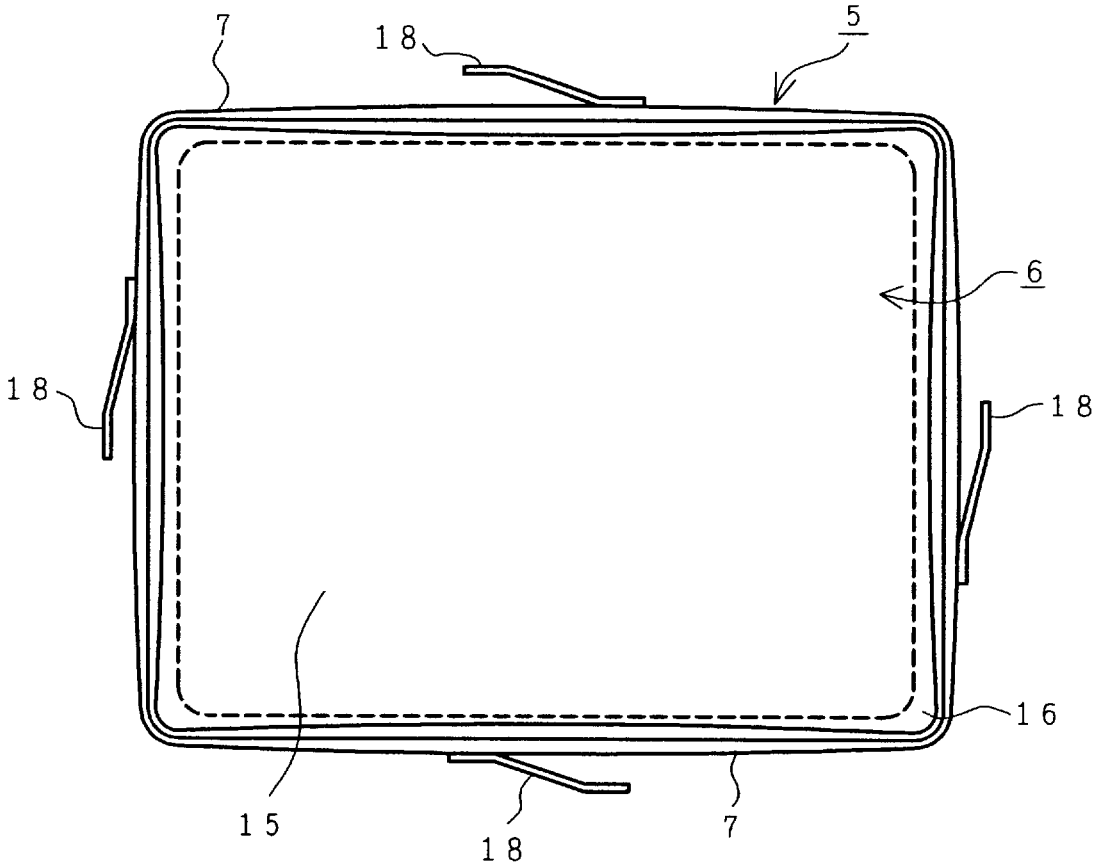
FIG. 2A is a plan view of the shadow mask structure used in the embodiment illustrated in FIG. 1 as seen from the panel side.
Figure 2B:
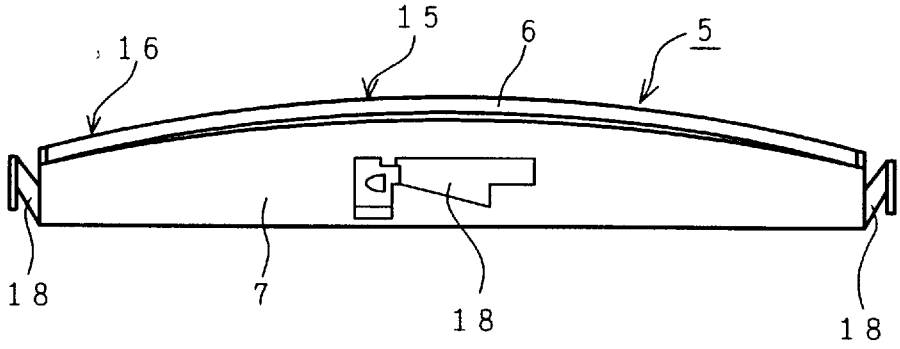
FIG. 2B is a side view of the structure of FIG. 2A.

FIG. 2A and FIG. 2B are structural views showing an example of the shadow mask structure 5 used for the embodiment shown in FIG. 1 wherein FIG. 2A is a plane view and FIG. 2B is a side view.

In FIGS. 2A and 2B, those components which are the same as the elements shown in FIG. 1 are identified with the same reference numerals.

As shown in FIG. 2A and FIG. 2B, the shadow mask structure 5 is made up of the shadow mask 6 and the support frame 7. The shadow mask 6 comprises the apertured portion 15, which has a given curved surface shape, a large number of electron beam transmission apertures (not shown in drawings) and constitutes an effective mask surface, the imperforate portion 16 of a narrow width, which is connected with the entire periphery of the apertured portion 15 and has a curved surface shape contiguous with the apertured portion 15 and has no apertures, and the skirt portion 17, which is bent back and vertically extends from the entire periphery of the imperforate portion 16, such that the skirt portion 17 has a given height. The shadow mask 6 is integrally formed by press-forming a metal material. The support frame 7 comprises an approximately rectangular frame portion 71, which includes two long sides of two short sides and four corners sandwiched by neighboring sides, and a flange portion 72 which protrudes inwardly and approximately perpendicularly from one end of the frame portion. The frame portion 71 is provided with retaining springs 18 on the outer side of approximately central portions of the respective sides thereof. The skirt portion 17 of the shadow mask 6 is fitted into the inside of the frame portion 71 of the support frame 7, and, thereafter, the skirt portion 17 and the frame portion 71 are spot welded to each other so as to form the shadow mask structure 5.

Figure 3A:
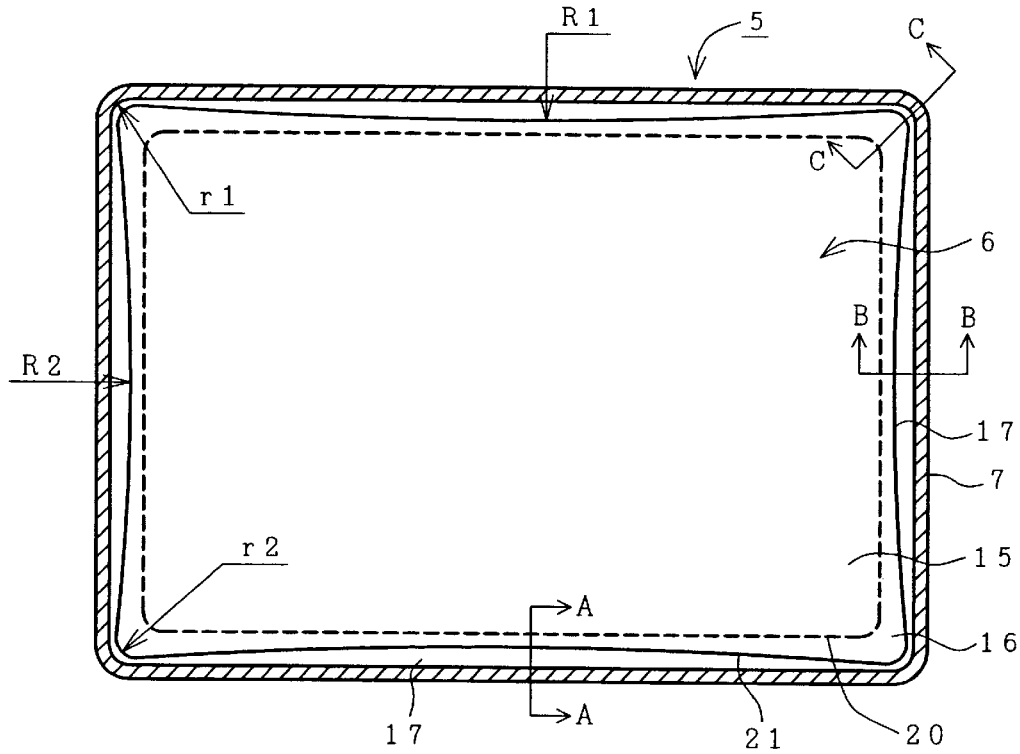
FIG. 3A is a partial plan view of the shadow mask structure shown in FIG. 2A.
Figure 3B:
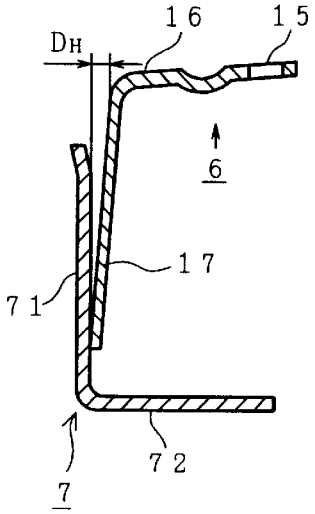
FIG. 3B is a cross-sectional view taken along a line A—A of FIG. 3A.
Figure 3C:
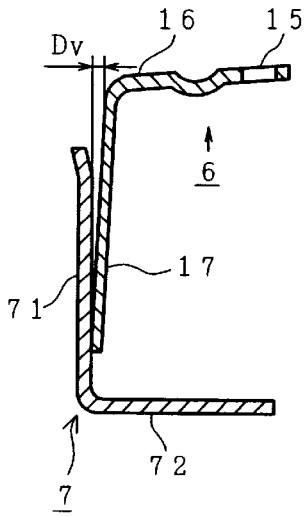
FIG. 3C is a cross-sectional view taken along a line B—B of FIG. 3A
Figure 3D:
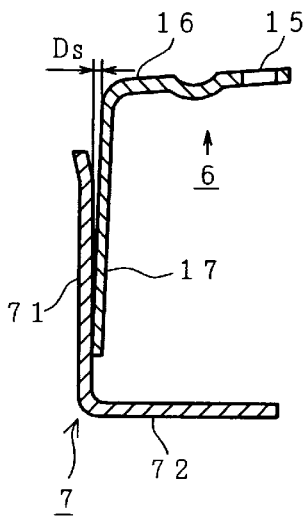
FIG. 3D is a cross-sectional view taken along a line C—C of FIG. 3A.
Figure 4A:
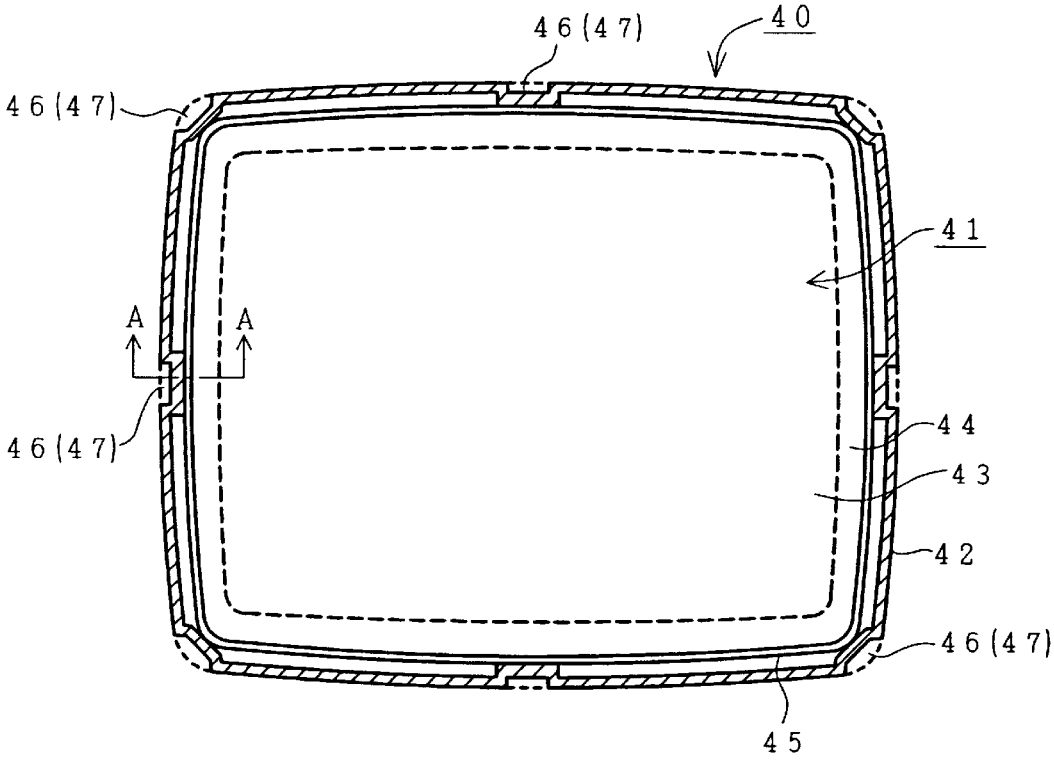
FIG. 4A (PRIOR ART)
FIG. 4A is a partial plan view of a known shadow mask structure.
Figure 4B:
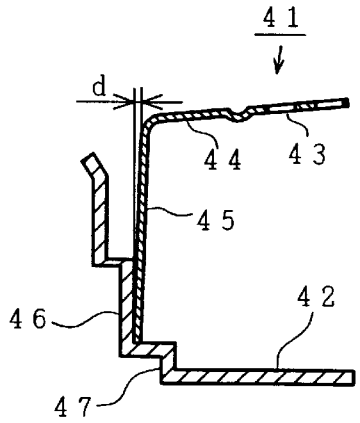
FIG. 4B (PRIOR ART)
FIG. 4B is a cross-sectional view taken along a line A—A of FIG. 4A.

FIG. 3A to FIG. 3D are structural views showing the detailed construction of the shadow mask structure 5 shown in FIG. 2A and FIG. 2B, wherein FIG. 3A is a plan view of the shape of the skirt portion 17 of the shadow mask 6 and the shape of the frame portion 71 of the support frame 7 as seen from the panel side. FIG. 3B is a cross sectional view of FIG. 3A taken along a line A—A. FIG. 3C is a cross sectional view of FIG. 3A taken along a line B—B, and FIG. 3D is a cross sectional view of FIG. 3A taken along a line C—C. The line AA of FIG. 3A is positioned at approximately the center of the long sides, while the line B—B of FIG. 3A is positioned at approximately the center of the short sides.

In FIG. 3A to FIG. 3D, those elements which are the same as the elements shown in FIG. 2A and FIG. 2B are identified with the same reference numerals.

As shown in FIG. 3A, the frame portion 71 of the support frame 7 has no welding bosses on the two long sides and the two short sides thereof. The frame portion 71 is formed such that it has an approximately straight-lined shape as seen from the panel side, and the four corners are formed such that they are bent with a small radius of curvature r1 to have a curved surface. Furthermore, as seen from the panel side (the side of fitting the skirt portion 17 of the shadow mask 6), the skirt portion 17 of the shadow mask 6 is formed such that the two long sides and the two short sides thereof have all or the central portions thereof recessed inwardly with sufficiently large radii of curvature R1, R2 equal to or more than 20000 mm, and the four corners are integrally formed by a press forming such that they are bent with a small radius of curvature r2 to have a curved surface. The relationship between the radius of curvature r1 of the respective corners of the frame portion 71 and the radius of curvature r2 of the respective corners of the skirt portion 17 is determined such that r1 and r2 are set to be approximately equal, or r1 is set to be slightly smaller than r2.

In FIG. 3A, a broken line 20 represents a border between the apertured portion and the imperforate portion, while a solid line 21 represents a bent portion, which is a transitional region between the imperforate portion and the skirt portion. The above-mentioned respective radii of curvature R1, R2, r2 are radii of curvature of the bent portions.

The bent portions reside in a shape where the respective long sides and the respective short sides are recessed inwardly with sufficiently large radii of curvature, and the end of the skirt portion which extends from the bent portions has approximately the entire periphery thereof in contact with the frame portion.

Here, it is preferable that the shadow mask structure 5, which is constructed by fitting the skirt portion 17 of the shadow mask 6 into the inside of the frame portion 71 of the support frame 7 and by spot welding them in the vicinity of the center lines (center lines in a horizontal direction and center lines in a vertical direction) of the two long sides and the two short sides, and determined to meet the following respective conditions.

Namely, as shown in FIG. 3B, in the shadow mask structure 5, at portions (portions close to the welding points) of the two long sides where the center lines extend in a vertical direction, a minute distance (clearance) $D_H$ defined between the inner surface of the frame portion 71 and the outer surface of the skirt portion 17 which faces the inner surface is determined to meet the conditions 1.0 mm$\leqq D_H \leqq$1.8 mm. As shown in FIG. 3C, in the shadow mask structure 5, at portions (portions close to the welding points) of the two short sides where the center lines extend in a horizontal direction, a minute distance $D_V$ defined between the inner surface of the frame portion 71 and the outer surface of the skirt portion 17 which faces the inner surface is determined to meet the condition 1.0 mm$\leqq D_V \leqq$1.8 mm. Furthermore, as shown in FIG. 3D, in the shadow mask structure 5, at diagonal portions (portions close to the welding points) of the four corners, a minute distance (clearance) $D_S$ is defined between the inner surface of the frame portion 71 and the outer surface of the skirt portion 17 which faces the inner surface is determined to meet the condition 0.2 mm$\leqq D_S \leqq$1.0 mm.

Furthermore, by making the minute distances (clearances) DH, DV, DS have the relationship of $D_S$, $D_V \leqq D_H$, an operation to fit the shadow mask into the support frame is facilitated; and, furthermore, deformation of the apertured portion which may occur in the fitting operation can be restricted and the deformation of the apertured portion of the shadow mask which may occur at the time of operating the cathode ray tube can also be restricted.

The minute distances (clearances) $D_H$, $D_V$, $D_S$ are distances in a horizontal direction between the inner surface of the frame portion and the panel-side end of the outer surface of the skirt portion. The frame portion has the panel-side thereof slightly expanded or flared. The distances $D_H$, $D_V$, $D_S$do not include such an expansion of the frame portion.

According to the shadow mask structure 5 having the above-mentioned construction, the frame portion 71 of the support frame 7 is formed in a shape close to a plane having no bosses on the two long sides and the two short sides, and the skirt portion 17 of the shadow mask 6 is formed in a shape where the two long sides and the two short sides are recessed inwardly with sufficiently large radii of curvature. Accordingly, in the assembling operation to fit the skirt portion 17 into the frame portion 71, even when some curl is present on the skirt portion 17, the skirt portion 17 can be smoothly fitted into the frame portion 71. Besides the favorable operability in such a fitting operation, even after completing the fitting operation, the apertured portion 15 of the shadow mask 6 is free from any large stress so that the apertured portion 15 of the shadow mask 6 suffers from no deformation.

Furthermore, when the skirt portion 17 has been completely fitted into the frame portion 71, the fitted portion of the skirt portion 17 has the entire periphery thereof in contact with the inside of the frame portion 71 so that close contact between the skirt portion 17 and the frame portion 71 is remarkably achieved. Accordingly, the magnetic resistance between the shadow mask 6 and the frame portion 71 is small, and even when an external vibration is applied to the cathode ray tube, the shadow mask 6 is prevented from being vibrated.

As shown in FIG. 3B, at the long sides, the panel-side end of the inner wall of the frame portion and the skirt portion do not come into contact with each other, while the electron-gun-side end of the outside surface of the skirt portion and the inner wall of the frame portion come into contact with each other. Furthermore, as shown in FIG. 3C, at the short sides, the panel-side end of the inner wall of the frame portion and the skirt portion do not come into contact with each other, while the electron-gun-side end of the outside surface of the skirt portion and the inner wall of the frame portion come into contact with each other. Still furthermore, as shown in FIG. 3D, at the corner portions, the panel-side end of the inner wall of the frame portion and the skirt portion do not come into contact with each other, while the electron-gun-side end of the outside surface of the skirt portion and the inner wall of the frame portion come into contact with each other. Namely, along the entire periphery of the shadow mask structure, the panel-side end of the inner wall of the frame portion and the skirt portion do not come into contact with each other, while the electron-gun-side end of the outside surface of the skirt portion and the inner wall of the frame portion come into contact with each other.

Since the contact point between the skirt portion and the frame portion 71 is disposed away from the apertured surface of the shadow mask, even when either the support frame or the shadow mask is thermally expanded, a deformation of the apertured portion of the shadow mask can be restricted.

By providing a shadow mask structure where the minute distance (clearance) $D_H$ meets the condition 1.0 mm≦$D_H$≦1.8 mm, the minute distance (clearance) $D_V$ meets the condition 1.0 mm≦$D_V$≦1.8 mm, and the minute distance (clearance) $D_S$ meets the condition 0.2 mm≦$D_S$≦1.0 mm, deformation of the apertured surface can be restricted.

In case the minute distances $D_H$, $D_V$, $D_S$ are set to values below their respective lower limit values, when the shadow mask is thermally expanded, the panel-side end of the inner wall of the frame portion comes into contact with the skirt portion. The contact point between the panel-side end of the inner wall of the frame portion and the skirt portion is close to the apertured portion. Accordingly, when the contact position receives an additional force, the apertured surface is easily deformed. On the other hand, in case the minute distances $D_H$, $D_V$, $D_S$ are set to values above their respective upper limit values, the size of the screen becomes small or the frame becomes large.

Figure 5B:
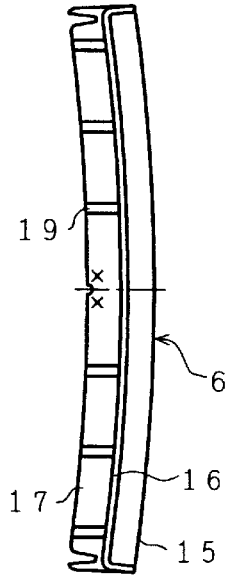
FIG. 5B is a side view as seen from the long side in FIG. 5A.
Figure 5A:
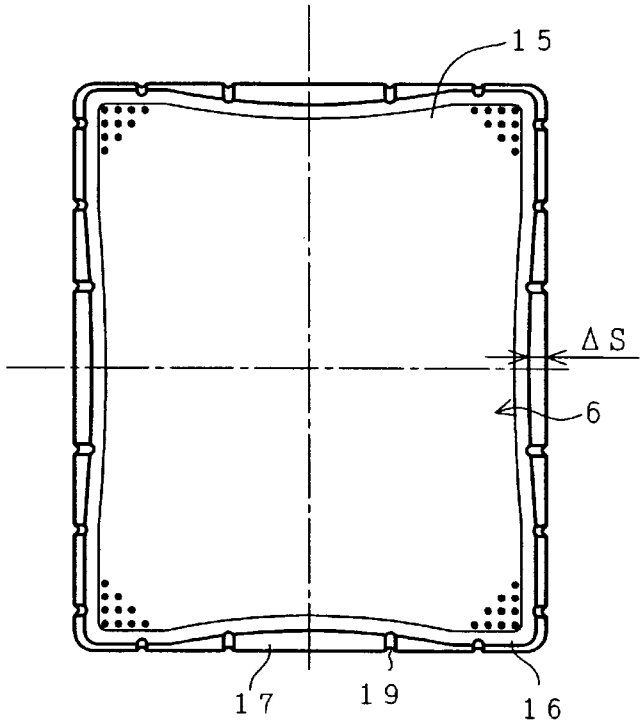
FIG. 5A is a plan view of the shadow mask applied to the cathode ray tube of the present invention.

FIG. 5A is a plan view of the shadow mask used for the shadow mask structure of the present embodiment, as seen from above. The short sides and the long sides are formed in a shape recessed toward the center of the shadow mask. The skirt portions 17 of the respective short sides and the respective long sides are provided with bulging portions 19 for controlling the amount of curl ΔS. The skirt portions of the central portions of the short sides and the long sides have a greater amount of curl ΔS than the skirt portions of the corner portions. Accordingly, the imperforate-portion side of the skirt portions of the respective sides is recessed toward the apertured-portion side. Due to such a construction, the outer contour of the end of the skirt portion 17 becomes approximately rectangular.

By fitting the shadow mask, which has the outer contour of the end of the skirt portion 17 formed in a rectangular shape, into the support frame, the end of the outside of the skirt portion 17 can make approximately the entire periphery thereof come into contact with the frame portion of the support frame.

FIG. 5B is a side view of the long side of the shadow mask. The long side is provided with four bulged portions. Furthermore, the welding points x between the support frame and the shadow mask are positioned approximately at the center of each side.

Figure 5D:
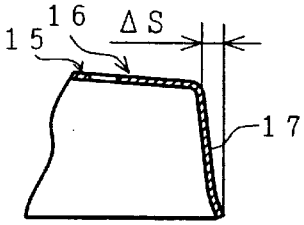
FIG. 5D is a partial cross-sectional view of the central portion of the long side.
Figure 5C:
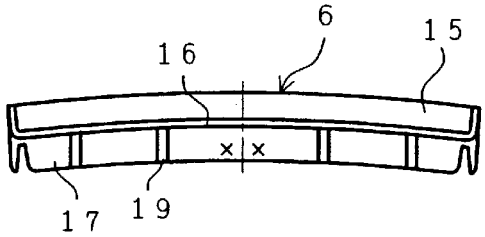
FIG. 5C is a side view as seen from the short side in FIG. 5A.

FIG. 5C is a side view of the short side of the shadow mask. The short side is provided with four bulged portions. Furthermore, the welding points x between the support frame and the shadow mask are positioned approximately at the center of each side.

FIG. 5D is a cross-sectional view of the skirt portion of the shadow mask. The shadow mask is provided with a controlled amount of Curl ΔS.

As shown in FIG. 5A to FIG. 5D, by providing the bulged portions, which extend in a tube axial direction of the cathode ray tube, on the skirt portion, the amount of curl ΔS of the skirt portion can be reduced.

In the shadow mask structure used for the cathode ray tube of the present invention, the amount of curl ΔS is necessary. Here, the necessary amount of curl ΔS is obtained by forming bulged portions.

In the above-described embodiment, since the bulged portions are formed on the skirt portion, the bulged portions are not closely brought into contact with the frame portion 71. However, the width of the bulged portion in a direction of the side is 4 to 12 mm so that the width is far smaller than the contact surface. Since the vicinity of the end of the outside of the skirt portion has almost the entire periphery thereof contact with the frame portion 71, the magnetic resistance between the shadow mask and the frame portion is small. Furthermore, in accordance with the present invention, even when an external vibration is applied to the cathode ray tube, the shadow mask per se is prevented from being vibrated.

In addition, in accordance with the present embodiment, although the amount of curl ΔS of the shadow mask is controlled by providing bulged portions on the skirt portion, which is made of Invar material, the amount of curl ΔS may be controlled by changing the material of the shadow mask.

Here, the skirt portion 17 of the shadow mask is fitted into the support frame while being pushed in a direction toward the inside of the shadow mask. Accordingly, the amount of curl ΔS of the skirt portion of the shadow mask does not necessarily register with the minute distances $D_H$, $D_V$, $D_S$ of the shadow mask structure. However, when the amount of curl ΔS of the skirt portion is smaller than the respective minute distances $D_H$, $D_V$, $D_S$, it becomes difficult to make the entire peripheries of the skirt portion and the frame portion come into contact with each other.

According to the shadow mask structure 5 of the present embodiment, it has been confirmed by a measurement of the magnetic resistance that the magnetic resistance between the shadow mask 6 and the frame portion 71 is reduced.

According to the color cathode ray tube using the shadow mask structure 5 of the present embodiment, the magnetic resistance between the shadow mask 6 and the frame portion 71 can be drastically reduced; and, hence, the amount of migration of the electron beam which may be caused by fluctuation of the terrestrial magnetism can be reduced. Furthermore, the close contact between the skirt portion 17 of the shadow mask 6 and the frame portion 71 is enhanced so that the shadow mask 6 per se is prevented from being vibrated, thus lowering the degree of occurrence of beam landing error.

In addition, according to the color cathode ray tube using the shadow mask structure 5 of the present embodiment, at the time of producing the shadow mask structure 5, the apertured portion 15 of the shadow mask 6 is not deformed, so that the strength of the shadow mask structure 5 can be sufficiently maintained.

In the above embodiment, the vicinity of the end of the outside of the skirt portion has the entire periphery thereof in contact with the frame portion 71. In an actual manufacturing process, since the shadow mask is formed by press-forming, wrinkles may appear on the skirt portion. Although the wrinkled portions of the skirt portion do not come into contact with the frame portion, since the wrinkled portions are in the form of extremely minute gaps, they can be ignored. It is preferable to conduct the press-forming, such that no wrinkle is formed on the skirt portion.

As has been described heretofore, in the shadow mask structure, the frame portion of the support frame is formed such that the respective long sides and the respective short sides thereof are formed in a shape close to a plane which has no welding bosses, and the skirt portion of the shadow mask is formed such that the respective long sides and the respective short sides thereof are recessed inwardly with a sufficiently large radii of curvature. Accordingly, at the time of manufacturing the shadow mask structure, in an operation to fit the skirt portion of the shadow mask into the inside of the frame portion of the support frame, the skirt portion can be fitted into the inside of the shadow mask while requiring at least force for pushing the skirt portion in a direction toward the inside of the shadow mask so that the operability at the time of fitting can be enhanced. Furthermore, after completing the fitting operation, no great stress is applied to the apertured portion of the shadow mask so that the apertured portion of the shadow mask is not deformed and the shadow mask can sufficiently maintain its strength.

Furthermore, according to the present invention, when the skirt portion has been completely fitted into the frame portion, the fitted portion of the skirt portion has its entire periphery in contact with the inside of the frame portion, so that close contact between the skirt portion and the frame portion is remarkably achieved, thus giving rise to an advantage in that the magnetic resistance between the shadow mask and the frame portion can be reduced. Furthermore, since the shadow mask per se is prevented from being vibrated even when an external vibration is applied to the cathode ray tube, an advantage is attained in that the degree of occurrence of beam landing error in the color cathode ray tube using this shadow mask structure can be reduced.

What is claimed is:

1. A color cathode ray tube including a shadow mask structure in which a skirt portion of a shadow mask is fixedly secured to a support frame, wherein the shadow mask structure comprises a generally rectangular shadow mask and a generally rectangular support frame, the shadow mask including an apertured portion having a plurality of electron beam transmission apertures, an imperforate portion disposed around the entire periphery of the apertured portion, and a skirt portion being bent back and drooping from the entire periphery of the imperforate portion, the support frame including a rectangular frame portion having two long sides without a welding boss, two short sides without a welding boss and four corners without a welding boss, and a flange portion which extends perpendicularly from the frame portion, the skirt portion of the shadow mask being fixedly secured to the inside of the rectangular frame portion by spot welding, and wherein a bent portion of the shadow mask which defines a transitional region between the imperforate portion and the skirt portion of the shadow mask is formed in a shape where the long sides and short sides thereof are recessed inwardly, and long sides of the skirt portion and short sides of the skirt portion come into contact with the frame portion.

2. A color cathode ray tube according to claim 1, wherein a radius of curvature of the recessed shape at the bent portion of the long side of the shadow mask is equal to or more than 20000 mm.

3. A color cathode ray tube according to claim 1, wherein a radius of curvature of the recessed shape at the bent portion of the short side of the shadow mask is equal to or more than 20000 mm.

4. A color cathode ray tube according to claim 1, wherein a radius of curvature of the recessed shape at the bent portion of the shadow mask is equal to or more than 20000 mm.

5. A color cathode ray tube according to claim 1, wherein the shadow mask structure formed by fitting the skirt portion of the shadow mask into the inside of the frame portion of the support frame and by spot welding them to each other meets the conditions $1.0\ \text{mm} \leqq D_H \leqq 1.8\ \text{mm}$, $1.0\ \text{mm} \leqq D_V \leqq 1.8\ \text{mm}$, $0.2\ \text{mm} \leqq D_S \leqq 1.0\ \text{mm}$, where $D_H$, $D_V$ and $D_S$ represent the distance between the inner peripheral surface of the end of the frame portion and the outer peripheral surface of the skirt portion which faces the inner peripheral surface of the end of the frame portion taken along a center line extending vertically at respective long sides, the distance along a center line extending horizontally at respective short sides and the distance along diagonal lines at respective corners, respectively.

* * * * *